US006531203B2

(12) United States Patent
Kessler et al.

(10) Patent No.: US 6,531,203 B2
(45) **Date of Patent: *Mar. 11, 2003**

(54) FLOOR MAT SYSTEM FOR SUPPORTING HEAVY LOADS

(75) Inventors: Ronald N. Kessler, Girard, OH (US); Myron E. Ullman, Canfield, OH (US)

(73) Assignee: R&L Marketing and Sales, Inc., Youngstown, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/059,722

(22) Filed: Jan. 29, 2002

(65) Prior Publication Data

US 2002/0086135 A1 Jul. 4, 2002

Related U.S. Application Data

(62) Division of application No. 09/411,969, filed on Oct. 4, 1999, now Pat. No. 6,352,757, which is a continuation-in-part of application No. 09/192,861, filed on Nov. 16, 1998, now Pat. No. 6,042,915, which is a continuation of application No. 08/822,730, filed on Mar. 24, 1997, now Pat. No. 5,958,538.

(51) Int. Cl.[7] ..... B32B 3/10

(52) U.S. Cl. ..... 428/137; 428/44; 428/47; 428/99; 428/120; 15/215; 52/177

(58) Field of Search ..... 428/44, 45, 47, 428/48, 120, 99, 138, 137; 52/177, 180, 489.1; 15/215; 404/36

(56) References Cited

U.S. PATENT DOCUMENTS

| | | | |
|---|---|---|---|
| 1,483,095 | A | 2/1924 | Kain |
| 2,070,839 | A | 2/1937 | Place |
| 3,158,962 | A | 12/1964 | Faase |
| 3,742,671 | A | 7/1973 | Ellis |
| 3,808,628 | A | 5/1974 | Betts |
| 3,846,945 | A | 11/1974 | Roby |
| 4,029,834 | A | 6/1977 | Bartlett |
| 4,143,194 | A | 3/1979 | Wihksne |
| 4,167,599 | A | 9/1979 | Nissinen |
| 4,361,614 | A | 11/1982 | Moffitt, Jr. |
| 4,361,925 | A | 12/1982 | Yamamoto et al. |
| 4,415,620 | A | 11/1983 | Yamazaki et al. |

(List continued on next page.)

FOREIGN PATENT DOCUMENTS

| | | |
|---|---|---|
| EP | 1 038 493 A2 | 9/2000 |
| GB | 2 066 061 A | 7/1981 |
| GB | 2 136 472 A | 9/1984 |
| GB | 87121 32.8 | 2/1998 |

OTHER PUBLICATIONS

Front Runner Matting Catalog May, 1994.

*Primary Examiner*—Alexander S. Thomas
(74) *Attorney, Agent, or Firm*—Joseph A. Sebolt

(57) ABSTRACT

A floor mat system having a plurality of individual floor mats disposed in a frame assembly includes floor mats sized in a manner so that a transport vehicle having wheels can be rolled over the floor mat system in any direction without two wheels of the transport vehicle contacting a single floor mat at any given time. This floor mat arrangement prevents two wheels of the transport vehicle from working together to dislodge the floor mats. As such, each individual floor mat of the system has a width and a length sized to be less than the wheel base distance and the tract distance of the transport vehicle. The width and length of each floor mat is also designed such that two wheels cannot reside on a single floor mat diagonally. The floor mats may also have a plurality of support knobs extending down from the ribs to provide additional support to the floor mat. The support knobs are configured and located so as not to clog the fluid flow channels under the floor mat.

22 Claims, 16 Drawing Sheets

U.S. PATENT DOCUMENTS 4,468,910 A 9/1984 Morrison
4,727,697 A 3/1988 Vaux
4,796,399 A 1/1989 Kessler et al.
4,798,029 A 1/1989 Carlton
4,822,658 A 4/1989 Pacione
4,877,672 A 10/1989 Shreiner
4,963,054 A 10/1990 Hayashi
5,191,692 A 3/1993 Pacione
5,323,575 A 6/1994 Yeh
5,403,637 A 4/1995 Pickard et al.
5,486,392 A 1/1996 Green
5,509,244 A 4/1996 Bentzon
5,628,160 A 5/1997 Kung
5,882,764 A 3/1999 Kessler et al.
5,958,538 A 9/1999 Kessler
6,042,915 A 3/2000 Kessler
6,068,908 A 5/2000 Kessler et al.
6,127,015 A 10/2000 Kessler
6,352,757 B1 * 3/2002 Kessler et al. ..... 428/120

* cited by examiner

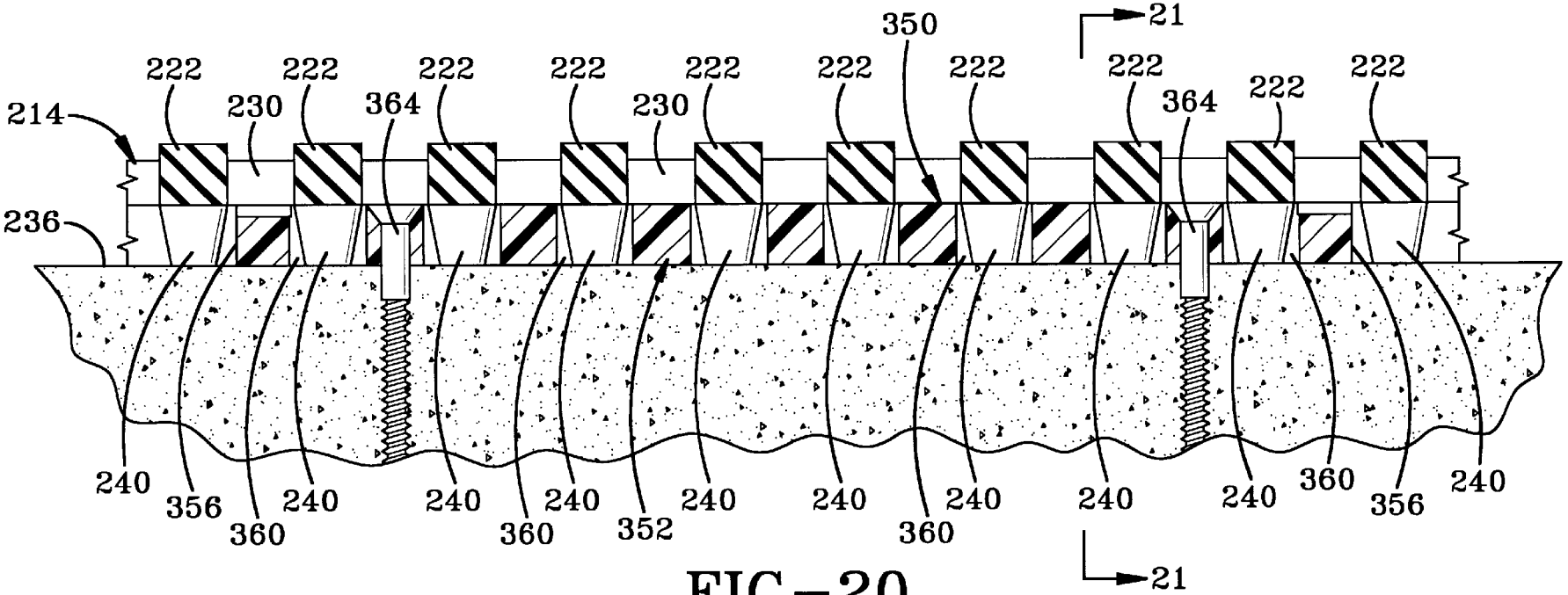
222
222
222

FLOOR MAT SYSTEM FOR SUPPORTING HEAVY LOADS

CROSS REFERENCE TO RELATED APPLICATION

This application is a division of application Ser. No. 09/411,969 filed Oct. 4, 1999, U.S. Pat. No. 6,352,757, which is a continuation-in-part application of U.S. Ser. No. 09/192,861, filed Nov. 16, 1998 U.S. Pat. No. 6,042,915 dated Mar. 28, 2000, which is a continuation of U.S. Ser. No. 08/822,730 filed Nov. 24, 1997 now U.S. Pat. No. 5,958, 538, dated Sep. 28, 1999; the disclosures of each are incorporated herein by reference.

BACKGROUND OF THE INVENTION

1. Technical Field

The present invention generally relates to a floor mat system and, more particularly, to a floor mat system designed specifically to support heavy rolling loads. Specifically, the present invention relates to a floor mat system having a plurality of support knobs disposed between the support ribs to provide extra support to the floor mat while allowing liquid to readily flow beneath the floor mat and to provide room for debris to collect under the floor mat. The invention also relates to a floor mat system having a plurality of individual floor mats that are sized and arranged to support a heavy rolling load with only one wheel of the load being positioned on one mat at a time so that the floor mats do not move out of place.

2. Background Information

Floor mats are often used at the entrances of businesses for customers to wipe water and snow from the bottoms of their shoes. Conventional floor mats are constructed of a flexible rubber and are formed with a plurality of spaced apart orthogonal ribs which form rectangular-shaped openings. These conventional floor mats require that a recessed area be formed in the floor where the floor mats are located with the edges of the recessed area preventing the floor mats from sliding when walked upon by a customer. The water and snow from the customer's shoes flows through the openings keeping the top surface of the floor mat free of standing water.

Although these prior art floor mats are adequate for the purpose for which they were intended, the business owner must plan for the installation of these floor mats and have the recessed area built into the floor during construction of the building. If these prior art floor mats are merely placed on the floor without a recessed area the floor mats slide when a horizontal pressure from a customers shoes or from strong wind is applied on the mats. Alternatively, the recessed area can be dug out of the floor after the building has been constructed at a great expense to the business owner. Additionally, even when a recessed area has been provided to accept the floor mat, if large mats are utilized, or a number of mats are utilized adjacent one another, the mats may still move within the recessed area possibly causing an unsafe condition.

Another type of floor mat merely sits on the floor allowing the water and snow from the customers' shoes to flow through the openings. Unless these floor mats are surrounded by some type of frame, the water will eventually build up beneath the floor mat and flow back out into the traffic area creating a puddle of water in front of the floor mat where the customers step. If the floor mat is placed within the business owner's store, the water will eventually flow out into the aisles or walkways creating a slippery and hazardous condition.

Also, if the area to be covered by the floor mats is a relatively large area such as the entrance or exit to a supermarket, a plurality of these floor mats must be placed at the entrance way to collect the snow and water from customer's shoes. If each of these plurality of floor mats is contained within its own separate frame, the front floor mats which the customers walk upon first will collect a majority of snow and water while the floor mats closer to the door will be relatively dry. Eventually, the front floor mats will fill with water causing an overflow of water into the walkway or causing standing water on the top surface of the mat.

Therefore, the need exists for an improved floor mat system having inner and outer frame members which extend between and around, respectively, a plurality of floor mats, which frame members attach directly to the floor to restrict movement of the floor mats, in which the frame members include a seal receiving recess formed in a bottom end thereof for selectively receiving a seal and which the mats are easily removable from within the frame to allow the water under the mat to be cleaned up and which are easily placed back in the frame.

Floor mats are also used between the storage areas in retail establishments and the display or retail environment of the retail establishment. These floor mats are intended to prevent dirt, water, and other debris from entering the retail environment from the storage environment where goods are unloaded from trucks. These floor mats are subjected to foot traffic as well as traffic from wheeled transport vehicles such as loaders or pull carts that are used to move goods from the storage area to the retail environment of the store. These transport vehicles are typically very heavy and include relatively small wheels in order to keep the height of the transport vehicle low. These transport vehicles typically have three or four wheels.

A problem has occurred in the art when these transport vehicles are rolled over prior art floor mats. It has been found that the movement of the transport vehicle over the floor mat causes the floor mat to "creep" or move out of its intended location. This movement is believed to occur when the wheels of the transport vehicle engage the floor mat under a heavy load. The floor mats must be manually repositioned after such movement. One solution has been to fasten the floor mat to the floor with clips to prevent the mats from moving. Although this is functional, the clips prevent the mats from being readily pulled up during cleaning. It is thus desired in the art to provide a floor mat system for use with relatively heavy, wheeled transport vehicles that will allow the transport vehicle to be rolled over the floor mat system without moving the floor mat system.

Another problem with prior art floor mat systems is that the rib structure of the floor mats is designed to support foot traffic and is not designed to carry the relatively heavy point loads created by a wheeled transport vehicle. Prior art rib structures allow the point load of a small wheel to depress the floor mat between ribs eventually causing damage to the floor mat and allowing the wheel to obtain a better grip on the floor mat to move the floor mat. One solution to this problem has been to create floor mats with ribs that are closely adjacent. The problem with floor mats having closely adjacent ribs is that there is little room for the floor mat to collect debris and little room for the liquid under the floor mat to flow. Another solution has been to provide a floor mat having intersecting ribs. The problem with floor mats having intersecting ribs is that the intersecting ribs prevent liquid from flowing under the floor mat to a drain positioned in one area of the floor mat. As such, it is desired in the art to provide a floor mat structure that is capable of supporting relatively heavy rolling point loads while maintaining liquid flow channels and room for debris under the floor mat.

SUMMARY OF THE INVENTION

Objectives of the invention include providing a floor mat system which is easily installed onto any floor without substantial modification to the floor.

Another objective is to provide a floor mat system in which the floor mat is constructed of a flexible durable material which will withstand inclement weather.

A further objective is to provide a system which includes a frame attached to the floor which forms a well for receiving the floor mat and restricting movement of the floor mat.

A further objective is to provide a system in which the floor mat can be easily removed from the frame to allow clean-up of any dirt, debris or water under the mat and which can easily be placed back within the frame after cleanup.

Still another objective is to provide a system in which the frame members can be easily installed into existing recessed areas to replace old mat systems.

Another object is to provide a system which allows water to be evenly directed and dispersed under the floor mats.

A further objective is to provide such a system which may be sealed under certain sections of the frame to selectively prevent or contain the flow of water thereunder.

Another objective of the present invention is to provide a system that will support heavy rolling loads without moving out of place.

Another objective of the present invention is to provide a floor mat system having a structure that supports relatively large point loads in a manner that does not block the liquid flow channels under the floor mat and provides space to collect debris.

Another objective of the present invention is to provide a floor mat system having a clip that releasably anchors the floor mats to a floor with the clip cooperating with the structure that supports the relatively large point loads.

A still further objective of the invention is to provide such a floor mat system which is of simple construction, which achieves the stated objectives in a simple, effective and inexpensive manner and which solves problems and satisfies needs existing in the art.

These objectives and advantages are obtained by the improved floor mat system of the present invention that is adapted to lie against a floor, the general nature of which may be stated as including a plurality of support ribs, each support rib having a lower surface, the lower surfaces being adapted to rest on the floor, a plurality of first ribs disposed transverse to the support ribs, the first ribs having a lower surface disposed vertically higher than the lower surface of the support ribs, and a plurality of support knobs extending downwardly from the lower surfaces of the first ribs.

Other objectives and advantages are obtained from the floor mat system of the present invention that is adapted to lie against a floor, the general nature of which can be stated as including a plurality of support ribs, each support rib having a lower surface, the lower surfaces being adapted to rest on the floor, at least a pair of first ribs disposed transverse to the support ribs, at least one middle rib extending between the first ribs and disposed intermediate the support ribs, the middle rib having a lower surface disposed vertically higher than the lower surface of the support ribs, and at least a first support knob extending downwardly from the lower surface of the middle rib.

Still other objectives and advantages are obtained from the floor mat system for supporting a heavy load in combination with a transport vehicle having a first wheel spaced from a second wheel, the general nature of which can be stated as including at least two floor mats, each of the floor mats having a width and a length and one of the length and the width of each floor mat being less than the distance between the first and second wheels of the transport vehicle.

Still other objectives and advantages are obtained from the method of supporting a wheeled transport vehicle on a floor mat system over a floor of the present invention wherein the wheeled transport vehicle has at least two wheels spaced apart by a first distance, the general nature of which can be stated as including the step of providing a floor mat system including a plurality of floor mats arranged in a grid with each of the floor mats in the grid having a width and a length, one of the length and the width being smaller than the first distance.

BRIEF DESCRIPTION OF THE DRAWINGS

The preferred embodiments of the invention, illustrative of the best modes in which applicant has contemplated applying the principles of the invention, are set forth in the following description and are shown in the drawings and are particularly and distinctly pointed out and set forth in the appended claims.

FIG. 20 is a sectional view of the clip holding the floor mat to the ground.

Similar numerals refer to similar parts throughout the drawings.

DESCRIPTION OF THE PREFERRED EMBODIMENTS

Figure 1:
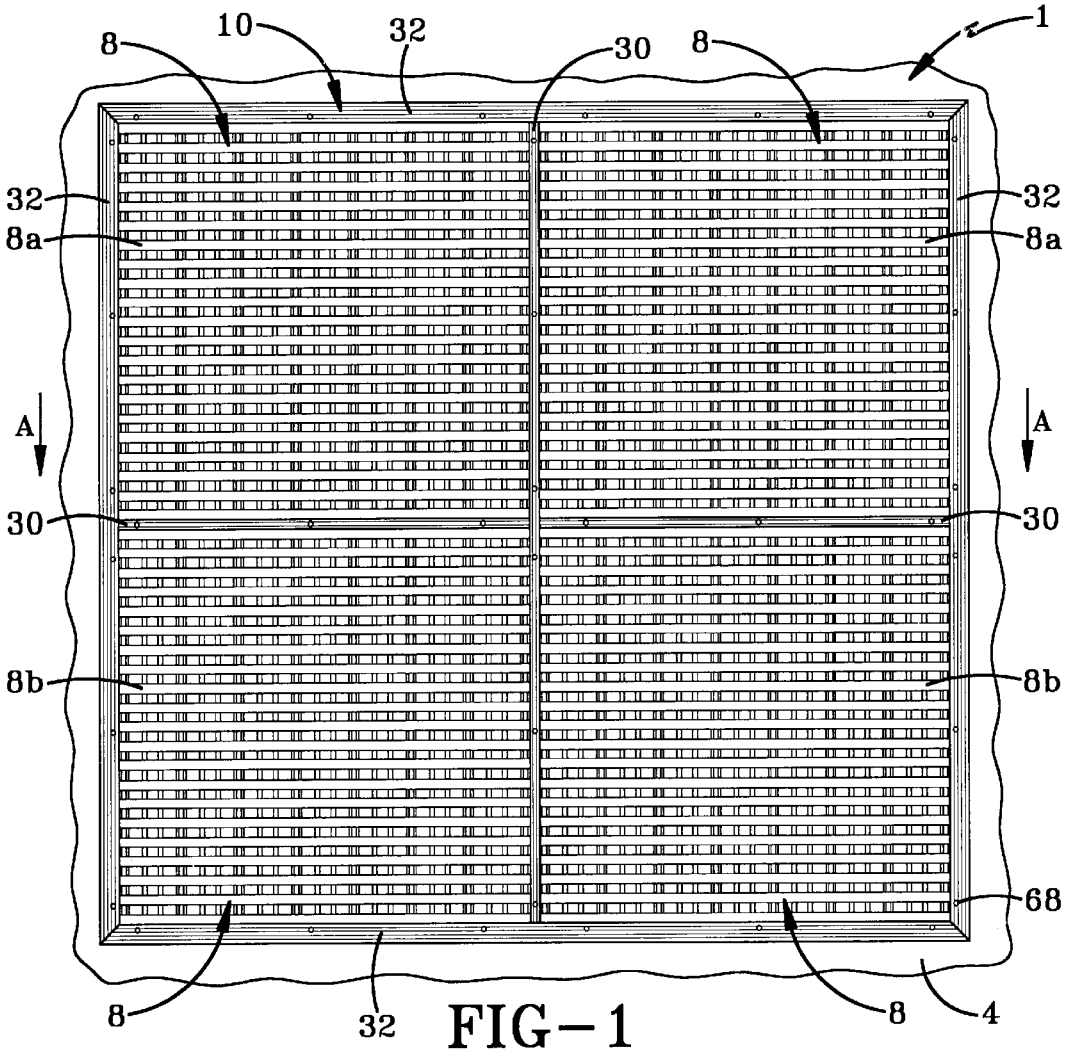
FIG. 1 is a top plan view of the floor mat system of the present invention.

The floor mat system of the present invention is shown in FIG. 1 and is indicated generally at 1. System 1 is shown in FIGS. 1–4 positioned directly on a floor 4. However, system 1 can be positioned within a recessed area which is formed in floor 4 without departing from the spirit of the present invention. Floor 4 may be constructed of various materials, such as wood or blacktop, and is shown in FIGS. 1–4 constructed of cement.

System 1 includes a plurality of floor mats, indicated generally at 8, and a frame assembly, indicated generally at 10 (FIG. 2), which extends around and between floor mats 8. In the preferred embodiment, floor mats 8 are 4 foot by 4 foot but may be various sizes without affecting the concept of the invention. Floor mats 8 include a series of first parallel rectangular-shaped ribs 14 (FIG. 4) which are spaced apart from one another by a distance substantially equal to their width, or approximately ¼ inches. A series of second spaced parallel rectangular-shaped ribs 17 extend perpendicular to and between first ribs 14 forming rectangular openings 20 therebetween.

In accordance with one of the features of the invention, second ribs 17 consist of a pair of middle ribs 18 which extend between a pair of support ribs 18*a*. Middle ribs 18 are approximately ⅛ inches wide and are separated from one another by a distance which is approximately 5⁄16 inches. Support ribs 18*a* have an enlarged bottom 21 which forms an upwardly facing shoulder 24 on each side of support ribs 18*a*. Support ribs 18*a* are spaced apart from adjacent middle ribs 18 by a distance of approximately ⅜ inches. Additionally, second ribs 17 are slightly shorter than first ribs 14 thereby creating a sculptured top surface of floor mat 8. Additionally, enlarged bottom 21 extends substantially below the bottom surface of first ribs 14 and of middle ribs 18 thereby suspending the majority of floor mat 8 above floor 4 thereby creating drainage channels 26 for water and debris scraped from customer's shoes.

Frame assembly 10 includes inner frame members 30 and outer frame members 32 which extend between and around, respectively, floor mats 8 as described below. Inner frame members 30 are elongated rectangular shaped members formed with a generally U-shaped seal receiving recess 36 in the bottom thereof. Inner frame members 30 include a top surface 38 which is formed with a pair of spaced parallel raised projections 40 extending the entire length of inner frame members 30 and a pair of opposed sidewalls 42 having a bottom end 44 positioned on each side of recess 36.

Outer frame members 32 are elongated and generally triangular shaped in cross-section. Outer frame members 32 have an inner sidewall 48, and angled top surface 50 which is tapered downwardly away from sidewall 48 and which includes a plurality of raised projections 52 formed along the entire length thereof, and a bottom end 54. Bottom end 54 is formed with a seal receiving recess 58 which includes a generally U-shaped section 60 formed adjacent sidewall 48, a generally triangular shaped section 62 formed at an angle similar to that of top surface 50 and a middle gap 64 which extends between and connects sections 60 and 62. Inner and outer frame members 30 and 32, respectively, are secured to floor 4 by a plurality of screws 68 which extend through the frame members and into floor 4.

In accordance with one of the main features of the invention, inner and outer frame members 30 and 32, respectively, may optionally and selectively receive a seal 70 and 72, respectively. Seal 70 is a generally tubular shaped member having a center hole 74 and is formed of a resilient material such as rubber. Seal 70 may be positioned within U-shaped seal receiving recess 36 and is sandwiched between inner frame member 30 and floor 4. The downward pressure of inner frame member 30 causes seal 70 to deform to the oval shape shown in FIG. 4 creating a watertight seal between inner frame member 30 and floor 4.

Seal 72 of outer frame member 32 is a generally flat piece of resilient material such as rubber, having first and second sides 76 and 78 and a flat intermediate section 80 extending between sides 76 and 78. Side 76 extends within U-shaped section 60 of seal receiving recess 58, flat intermediate section 80 is sandwiched within gap 64 of seal receiving recess 58 and side 76 extends within triangular shaped section 62 of seal receiving recess 58. Seal 72 is sandwiched between outer frame member 32 and floor 4 creating a watertight seal between outer frame member 32 and floor 4.

Figure 3:
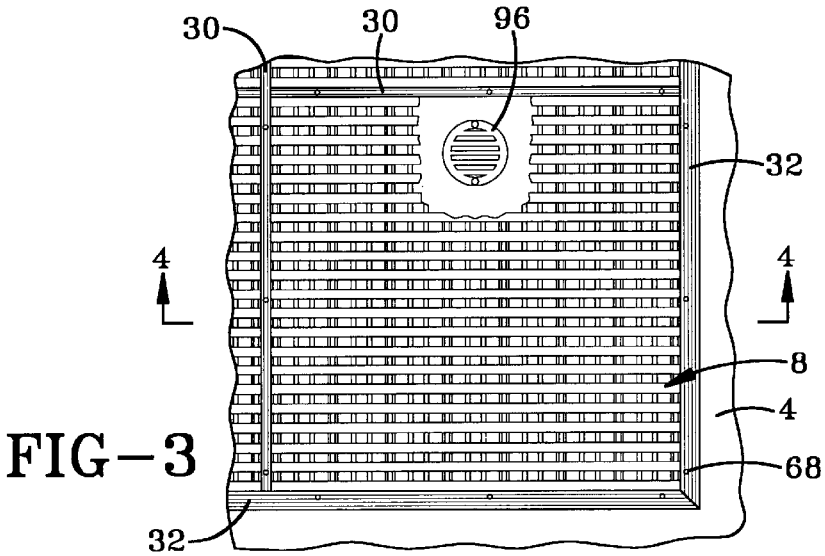
FIG. 3 is a fragmentary top plan view of the floor mat system of FIG. 1 with portion broken away.
Figure 2:
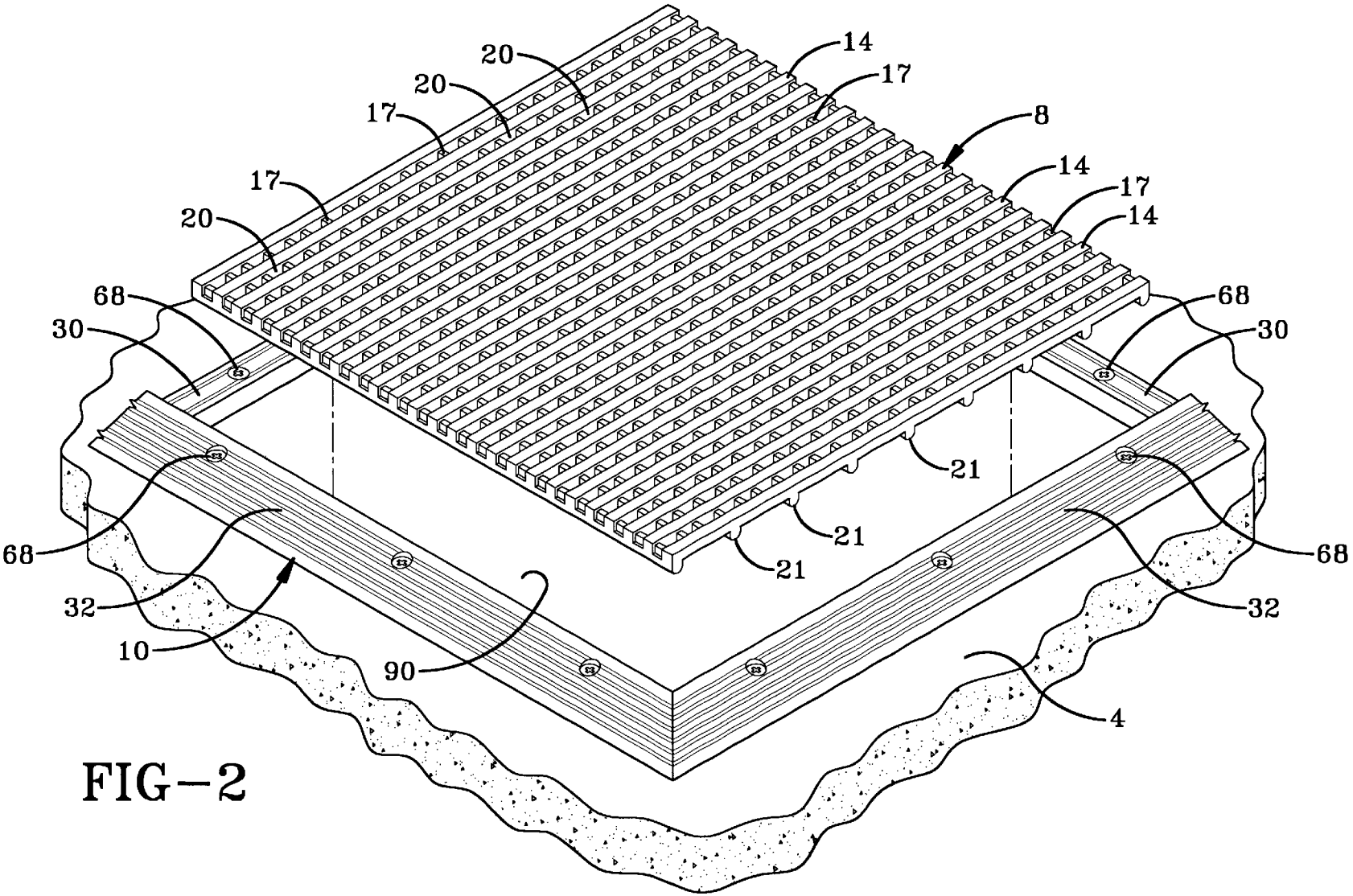
FIG. 2 is an exploded perspective view of the floor mat system of FIG. 1.
Figure 4:
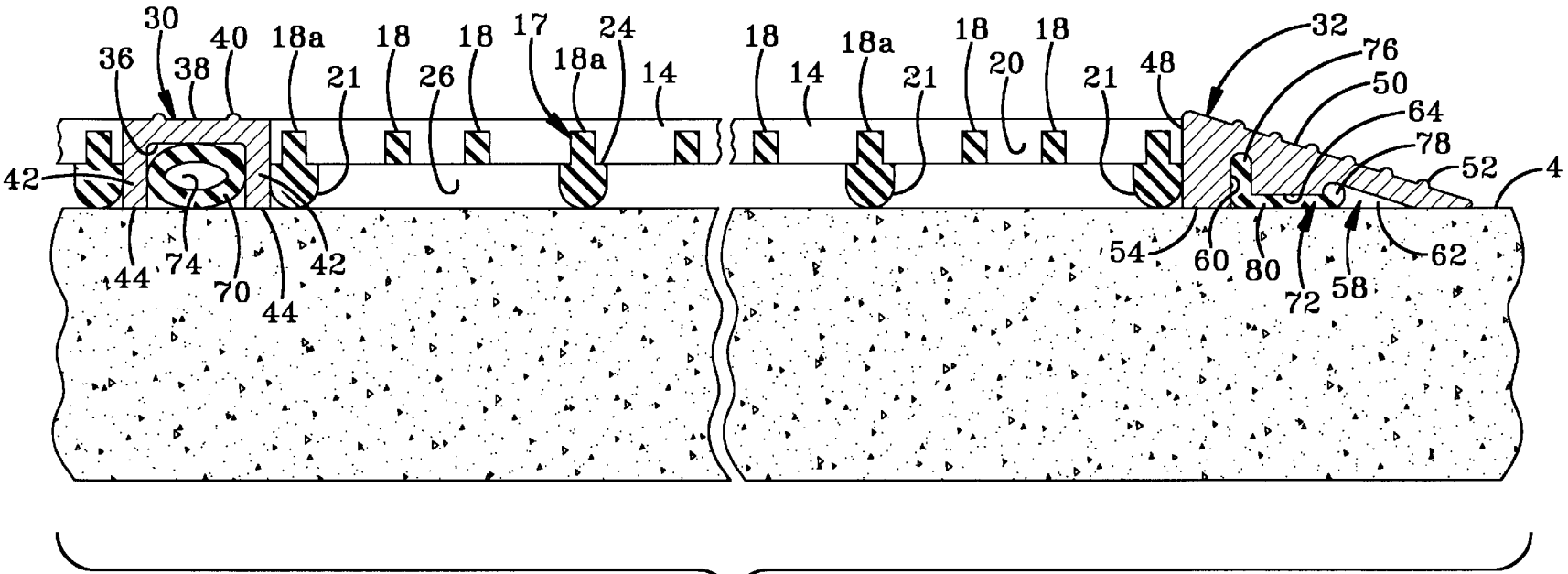
FIG. 4 is a fragmentary sectional view taken along line 4—4, FIG. 3.

When assembled, outer frame members 32 are attached to floor 4 defining a periphery of an area which floor mat system 1 is to cover. Outer frame members 32 have one of floor mats 8 adjacent to and abutting inner sidewall 48 thereof. Inner frame members 30 divide the area to be covered by floor mat system 1 into four by four foot wells 90 (FIG. 3). Inner frame members 30 have a floor mat 8 adjacent to and abutting each sidewall 42 thereof. Each well 90 receives one of floor mats 8 and prevents floor mats 8 from sliding or otherwise moving when walked upon by a customer. Outer frame members 32 and inner frame members 30 offer an additional benefit in that they are of consistent cross section and therefore are extrudable thereby substantially reducing manufacturing costs for floor mat system 1.

In the preferred embodiment, inner frame members 30 have a height of approximately 7⁄16 inches measured from top surface 38 to bottom ends 44 with projections 40 extending approximately 1⁄16 inches above top surface 38. Inner frame members 30 have a width of approximately ¾ inches with bottom ends 44 being ⅛ inches wide and seal receiving recess 36 being ½ inch wide. Similarly, outer frame members 32 have a height of approximately ½ inches measured from the top to the bottom of inner side wall 48. Outer frame members 32 have a width of approximately 1½ inches measured from inner side wall 48 to the outer tip or edge of frame member 32. Thus, outer frame members 32 have a height substantially equal to the height of inner frame members 30 measured from the top of projections 40 to bottom ends 44, or approximately ½ inches. Floor mats 8 are supported by support ribs 18*a* at a height of approximately 7⁄16 inches to allow floor mats 8 to sit relatively even with the top surface of inner frame members 30 creating a substantially flat floor mat system 1 with a sculptured top surface for scraping water and debris from customer's shoes. Projections 40 of inner frame members 30 and the top of outer frame members 32 are slightly higher than floor mats 8 to create additional scraping edges to scrape water and debris from customer's shoes. Top surface 50 of outer frame members 32 are ramped to prevent customers from tripping when stepping from floor 4 onto floor mat system 1.

As the water and debris is scraped from the customers shoes, it flows through openings 20 into drainage area 26 under floor mats 8. In a large area covered by a plurality of four by four foot floor mats 8, the front most floor mats will tend to accumulate a majority of the water and debris from the customer's shoes, eventually creating an overflow condition. By selectively inserting optional seals 70 and 72 within inner and outer frame members 30 and 32, respectively, the water and debris can be evenly distributed beneath floor mat system 1. For example, in the floor mat system of FIG. 1 where floor mats 8*a* are the front most floor mats which tend to collect a majority of the water and debris, and floor mats 8*b* are the back most floor mats which remain relatively dry, seal 70 may be removed or excluded from inner frame members 30 extending between floor mats 8*a* and 8*b* allowing the water and debris to flow in the direction of arrows A creating an even distribution of the water and debris under floor mat system 1. Floor mats 8*a* and 8*b* will eventually have to be removed from wells 90 allowing the water and debris to be cleaned from wells 90. Floor mats 8*a* and 8*b* are placed back within wells 90 for subsequent reuse.

Also, because floor 4 will not be perfectly flat and support ribs 18*a* will not lay perfectly flat on floor 4, there will be some leakage between drainage areas 26 which are formed between support ribs 18*a*. This leakage between drainage areas 26 allows a floor drain 96 (FIG. 3) to be formed under one of floor mats 8. Drain 96 provides for removal and drainage of water and debris from beneath floor mats 8. Seal 70 may be optionally inserted within any of inner frame members 30 to selectively create a desired flow of water to the area of drain 96. Further, seal 72 may be left out of a portion of one of outer frame members 32 in the event a drain is located outside or adjacent to floor mat system 1. The water or debris may be directed toward one side or end of floor mat system 1 creating a flow to an outer drain 96. Alternatively, floor mats 8 may be removed from wells 90 allowing the debris to be hosed from wells 90 with a water hose with the directional flow allowing the clean water to exit frame assembly 10 as described above.

Figure 5:
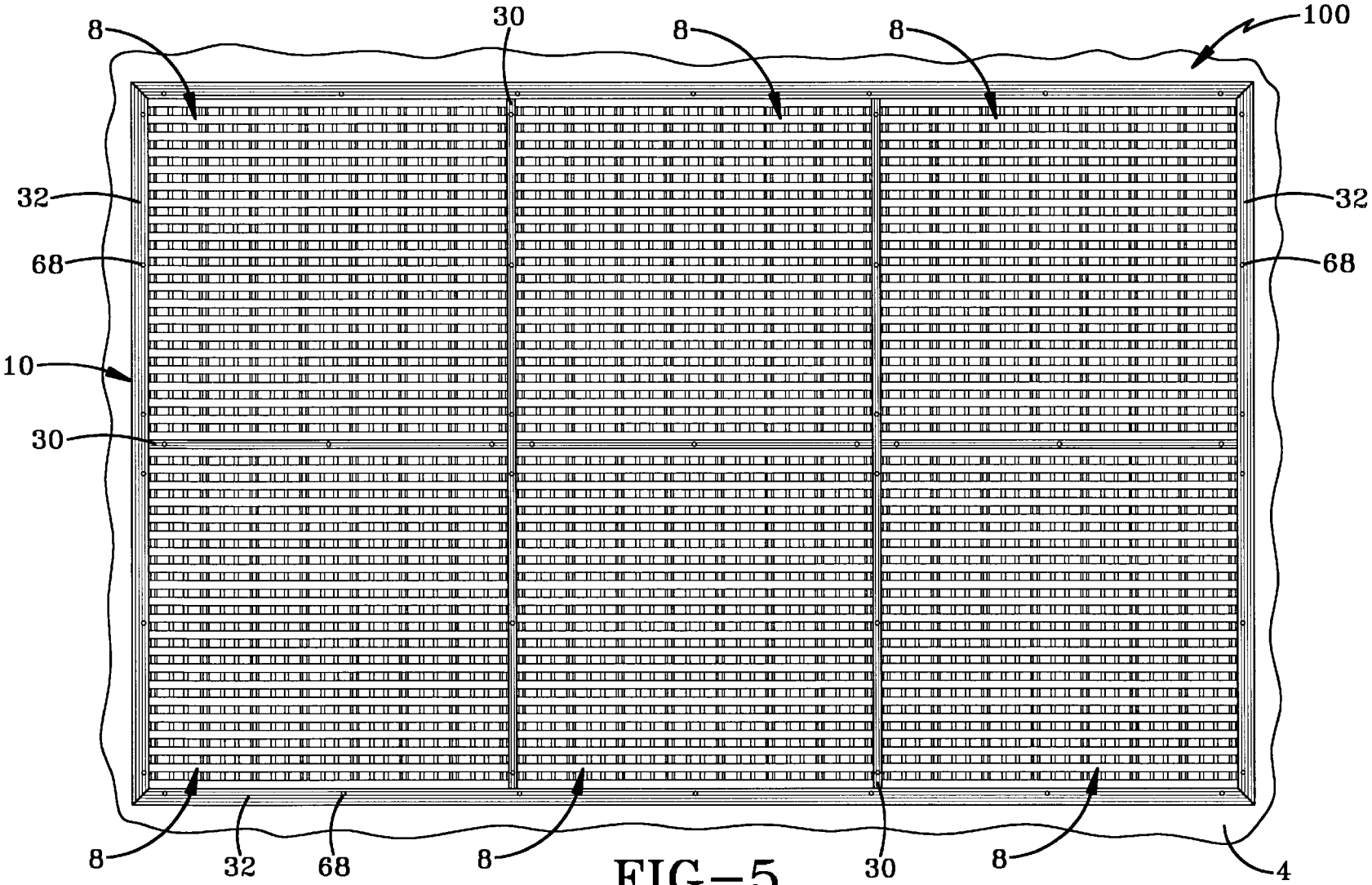
FIG. 5 is a top plan view of a second embodiment of the floor mat system of the present invention.

A second embodiment of the floor mat system of the present invention is indicated at 100 in FIG. 5 and shows six four by four foot floor mats contained within outer frame members 32 and is separated from one another by inner frame members 30. Floor mat system 100 shows that the floor mat system of the present invention may be used to cover any sized area with outer frame members 32 defining the periphery thereof. Any number of inner frame members 30 necessary to divide the area to be covered into four by four foot wells 90 may be included within outer frame members 32. Seals 70 and 72 may be optionally included within seal receiving recesses 36 and 58 of inner and outer frame members 30 and 32, respectively, to direct and disperse the flow of water and debris within drainage areas 26 beneath floor mats 8.

It is understood that floor mat system 1 may be placed within a recessed area formed in floor 4. In such an embodiment, the periphery of floor mat system 1 may be defined by the edges of the recessed area or alternatively, inner frame members 30 may be inserted within the recessed area around the edge thereof to define the periphery of the area to be covered by floor mats 8. Inner frame members 30 will thus have a floor mat 8 adjacent and abutting only one side thereof.

Also, inner frame members 30 may be cut in any manner which allows the inner frame members to form the four by four foot wells 90. For example, FIG. 5 shows one piece inner frame members 30 extending transversely between the longer outer frame members 32 and are of a length substantially equal to the eight foot length of two of floor mats 8 plus the width of the inner frame member extending between the two floor mats 8. For example, inner frame members 32 which extend longitudinally between the floor mats are cut into four foot sections and extend between the shorter outer frame members 32 and the one piece inner frame members 30, and between the one piece inner frame members. Further, it is understood that in the preferred embodiment, floor mats 8 and wells 90 are four foot by four foot but may be other square or rectangular shapes such as three by three foot or three by five foot without affecting the concept of providing a frame assembly having selectively insertable seals to direct and evenly disperse the flow of water beneath the mats.

Accordingly, floor mat systems 1 and 100 include a plurality of floor mats 8 and a frame assembly 10. Frame assembly 10 include inner and outer frame members 30 and 32, respectively, which are formed with seal receiving recesses 36 and 58, respectively. Outer frame members 32 define a periphery of an area to be covered by floor mat system 1 and inner frame members 30 divide the area into four by four foot wells 90. Floor mats 8 are four by four foot in size and are received within wells 90 to prevent any sliding movement thereof. A drainage area 26 is formed beneath floor mats 8 to allow water and debris to flow through openings 20 formed by ribs 14 and 17 of floor mat 8. Seals 70 and 72 may be optionally and selectively inserted within seal receiving recesses 36 and 58, respectively, to direct and disperse the water and debris which accumulates within drainage area 26. Drain 96 may be formed beneath floor mats 8 or adjacent floor mat systems 1 or 100 allowing seals 70 and 72 to be selectively inserted within inner and outer frame members 30 and 32, respectively, to direct the flow of water and debris towards the drain.

Figure 6:
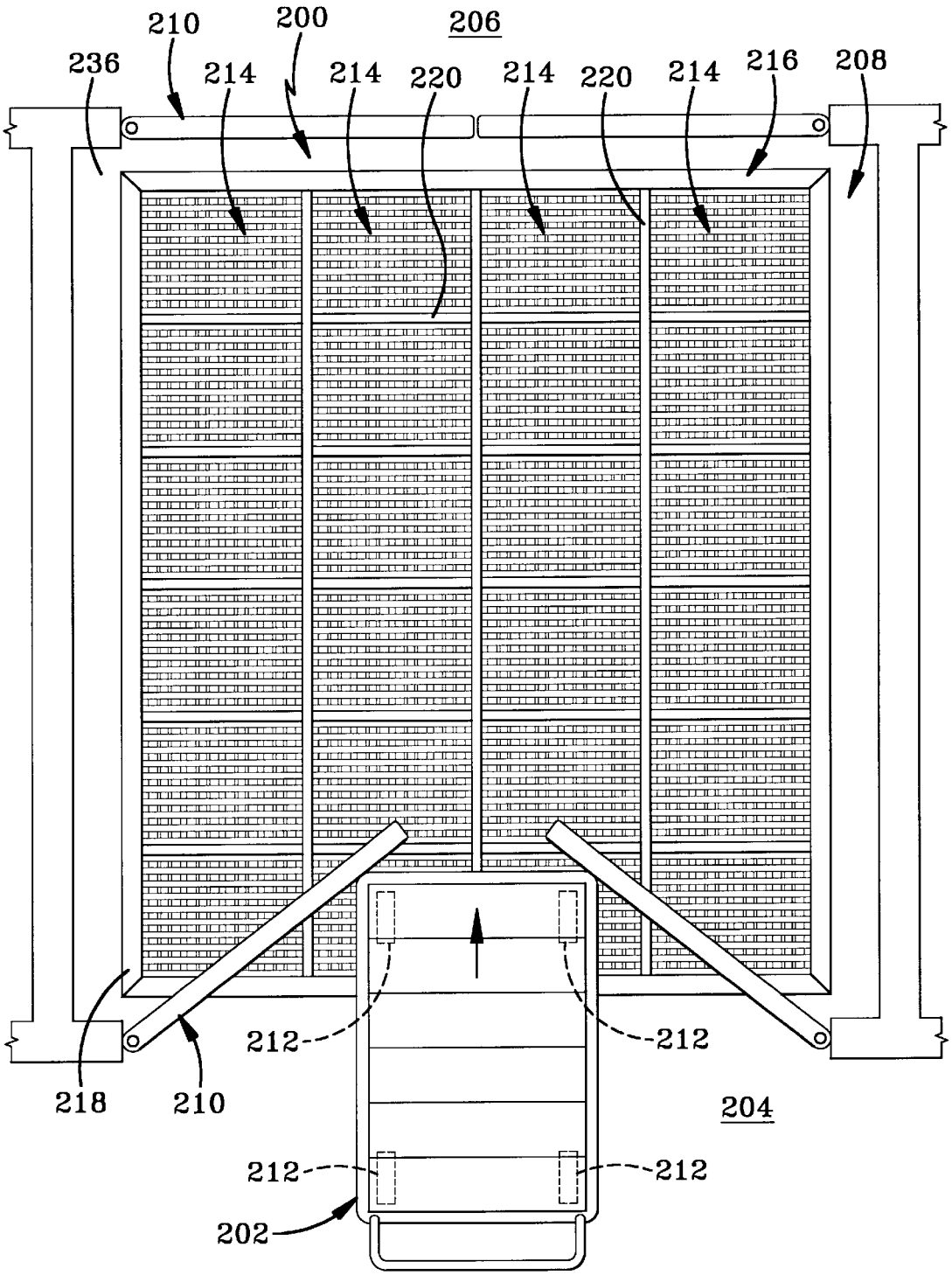
FIG. 6 is a top plan view of a third embodiment of the floor mat system of the present invention showing a rolling load being applied to the floor mat system.

A third embodiment of the floor mat system of the present invention is indicated generally by the numeral 200 in FIG. 6. Floor mat system 200 is intended to be used in areas that support heavy load traffic such as that created by pull carts, loaders, or other transport vehicles 202. Transport vehicle 202 is typically used to move inventory from an area such as a storeroom or loading dock 204 to a showroom or retail environment 206. In the example of the invention depicted in FIG. 6, floor mat system 200 is installed in a hallway 208 disposed between doors 210. Transport vehicle 202 thus necessarily passes over floor mat system 200 as it moves from stockroom 204 to showroom 206. Floor mat system 200 is intended to remove water and debris from the wheels 212 of transport vehicle 202 before the water or debris enters showroom 206. Floor mat 200 thus helps keep showroom 206 clean. Of course, floor mat system 200 may be used in any of a variety of locations and the position of system 200 is not to be limited to a location between walls. System 200 may be positioned in the middle of an open area where transport vehicle 202 or persons walking over system 200 may cross it in any direction.

Although the structure and configuration of the floor mat systems described above with respect to the first and second embodiments of the invention have been useful for their intended purposes, problems have occurred with their use when combined with relatively heavy rolling loads such as that created by transport vehicle 202. These problems are discussed above in the Background of the Invention section of this specification. In response to these problems, floor mat system 200 has been developed which includes a plurality of individual floor mats 214 arranged in a grid pattern within a frame system 216 including an outer frame 218 and at least one inner frame member 220. Outer frame 218 and inner frame members 220 can be either rigid, flexible, or semi-flexible depending upon the specific needs of the particular application. In this regard, outer frame 218 and inner frame members 220 can be made of any one of a variety of materials including aluminum, steel, rubber, plastic, as well as a variety of other materials without departing from the spirit of the present invention.

Each floor mat 214 is similar to the floor mats described above. In the preferred embodiment of the present invention, each floor mat 214 includes a series of spaced, substantially parallel, first rectangular-shaped ribs 222 which are spaced apart from one another by a distance substantially equal to their width. In the embodiment depicted in the drawings, the width is approximately one-quarter inch. In other embodiments of the invention, different widths and different spacing may be used without departing from the concepts of the present invention. A series of second spaced, parallel, rectangular-shaped ribs 224 extend substantially perpendicular to and between first ribs 222 forming rectangular openings 226 therebetween.

Second ribs 224 include support ribs 228 and may optionally include middle ribs 230. In the embodiment of the invention depicted in the drawings, middle ribs 230 are disposed in pairs and are approximately one-eighth inch wide and are separated from one another by a distance from about one-eighth to three-eighths inch and preferably five-sixteenths inch. Support ribs 228 have an enlarged bottom 232 that forms an upwardly facing shoulder 234 on each side of support ribs 228. The lower most surface of each support rib 228 is substantially planar and is intended to support floor mat 214 on the floor 236. Support ribs 228 are spaced apart from the closest adjacent middle rib 230 by distance of approximately three-eighths inch. Second ribs 224 are slightly shorter than first ribs 222 thereby creating a sculptured top surface on floor mat 214. Support ribs 228 support middle ribs 230 and first ribs 222 above floor 236 thereby creating drainage channels or liquid flow channels 238 for water and debris scraped from shoes or wheels 212 above.

Figure 7:
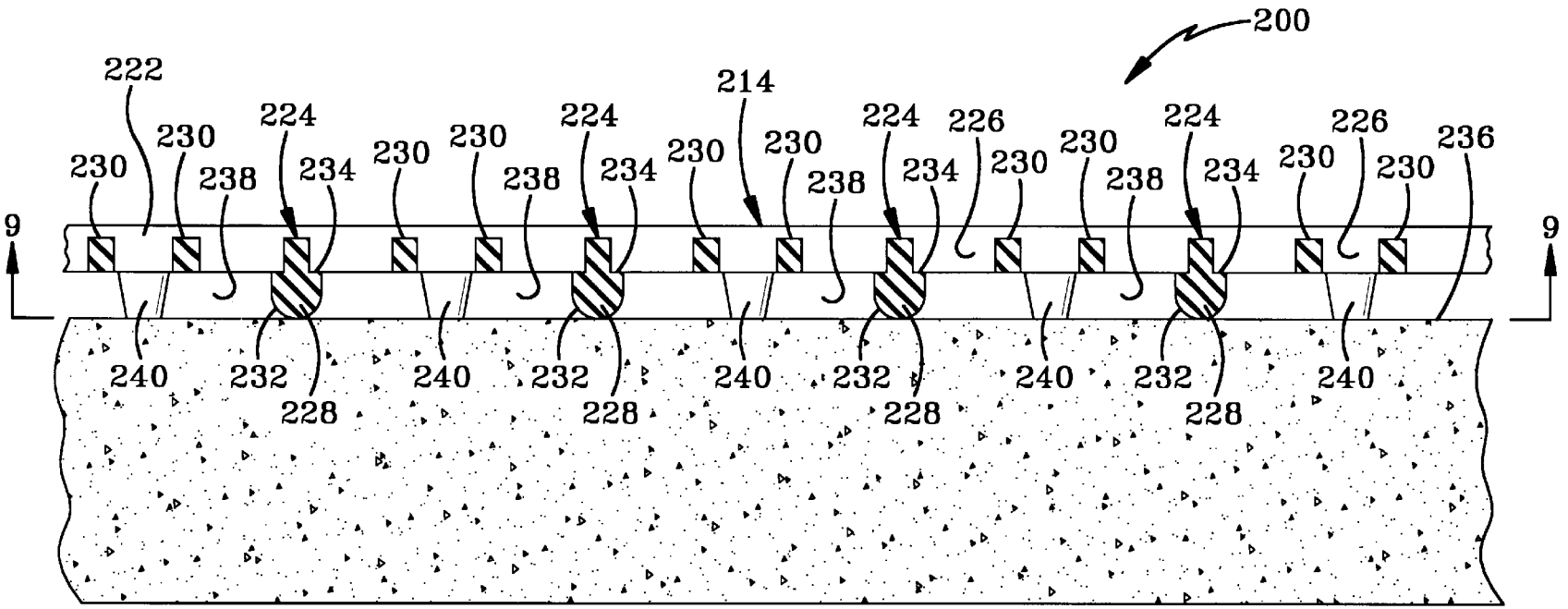
FIG. 7 is a sectional side view of a portion of one of the floor mats of the system of the third embodiment.

In accordance with one of the objectives of the present invention, floor mat 214 further includes a plurality of support knobs 240 that extend down from the lower surface of first ribs 222 and engage floor 236 to provide additional support to floor mat 214. In the embodiment of the invention depicted in FIG. 7, each support knob 240 is conical with its wider base connected to the lower surface of each first rib 222 and is disposed substantially centrally between support ribs 228. Each support knob 240 is substantially the same height as enlarged bottom 232 of support ribs 228 so that support knobs 240 work in cooperation with support ribs 228 to provide support to floor mat 214.

Support knobs 240 also allow drainage channels 238 to remain substantially open. Support knobs 240 are not large enough to block the flow of water within drainage channels 238 and are not large enough to prevent debris from gathering under floor mat 214. However, support knobs 240 provide extra support to floor mat 214 such that the relatively heavy point loads created by wheels 212 of transport vehicle 202 do not cause ribs 222 or 230 to collapse between support ribs 228 when transport vehicle 202 is rolled across floor mat 214.

Figure 8:
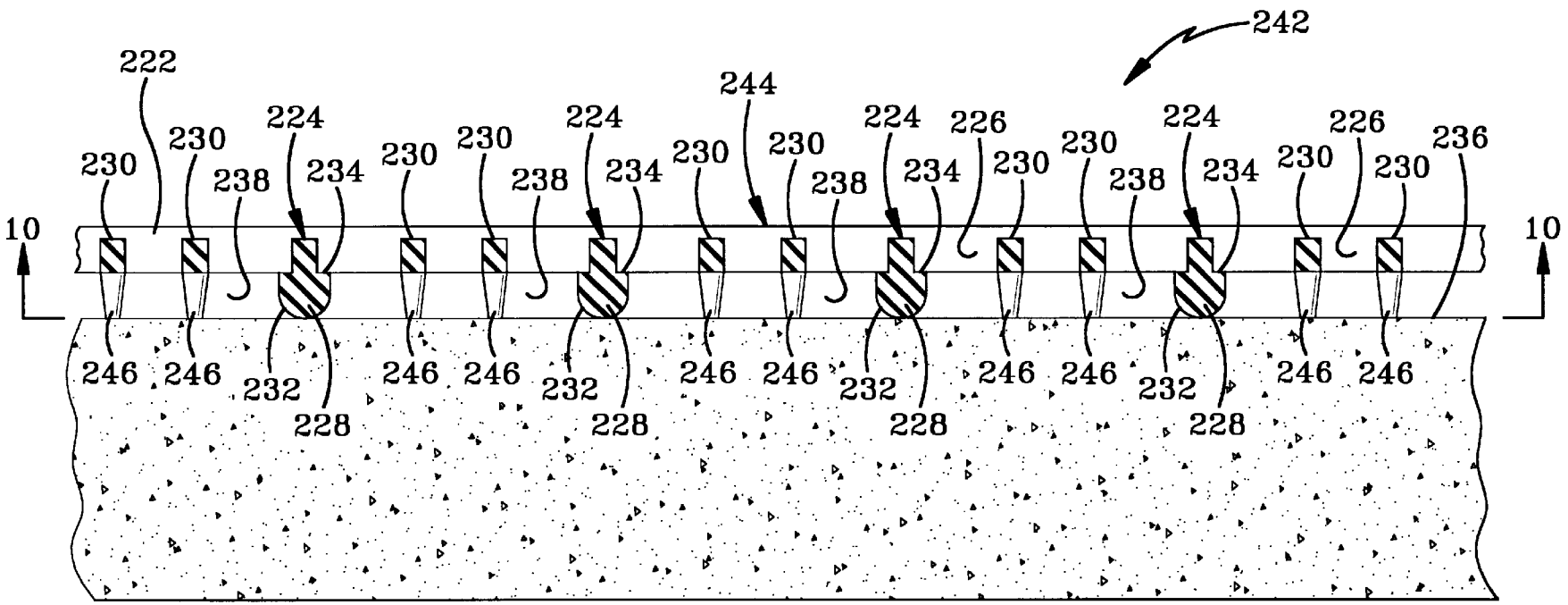
FIG. 8 is a sectional view similar to FIG. 7 showing a fourth embodiment of the floor mat.
Figure 9:
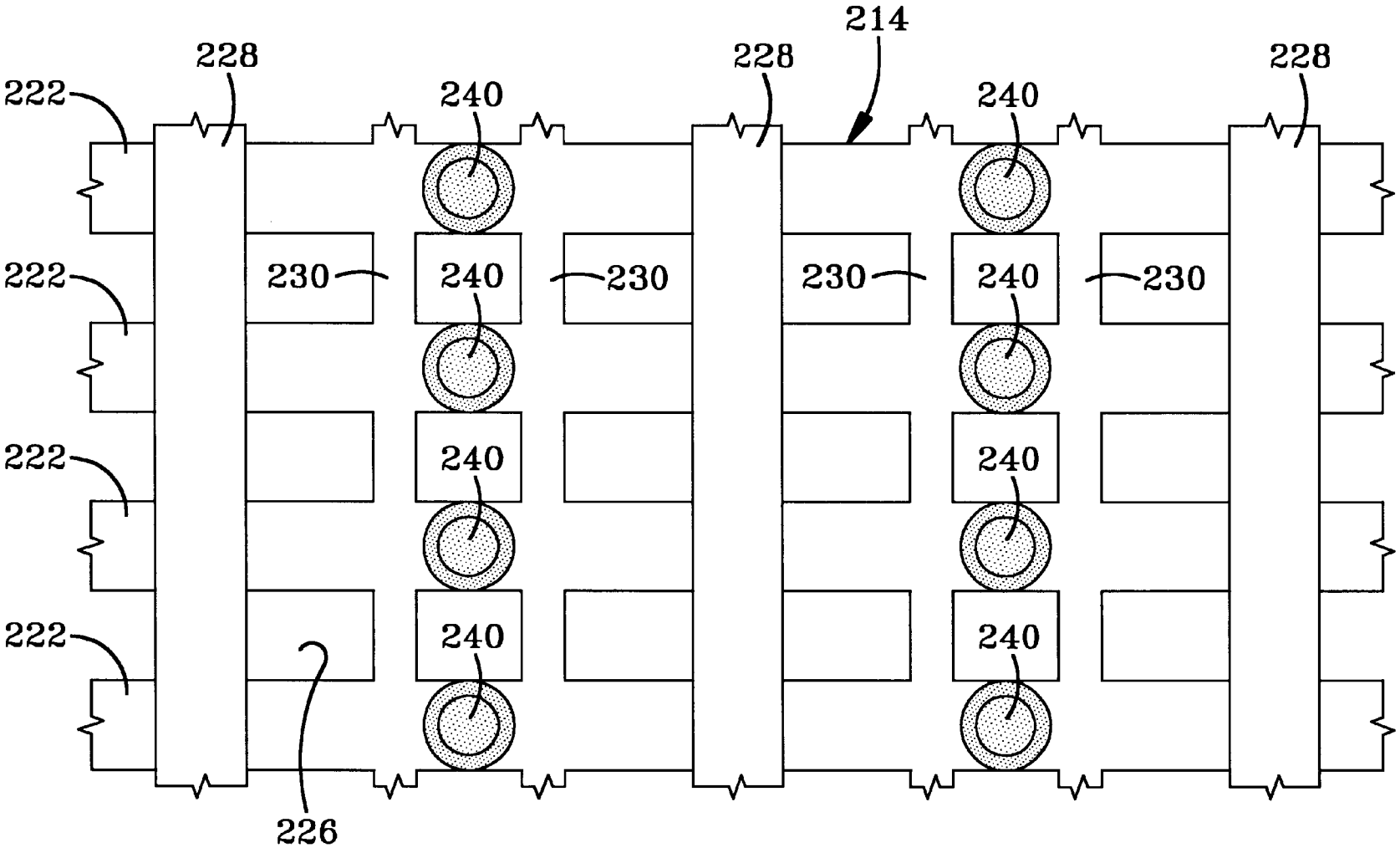
FIG. 9 is a bottom plan view taken along line 9—9 of FIG. 7.
Figure 10:
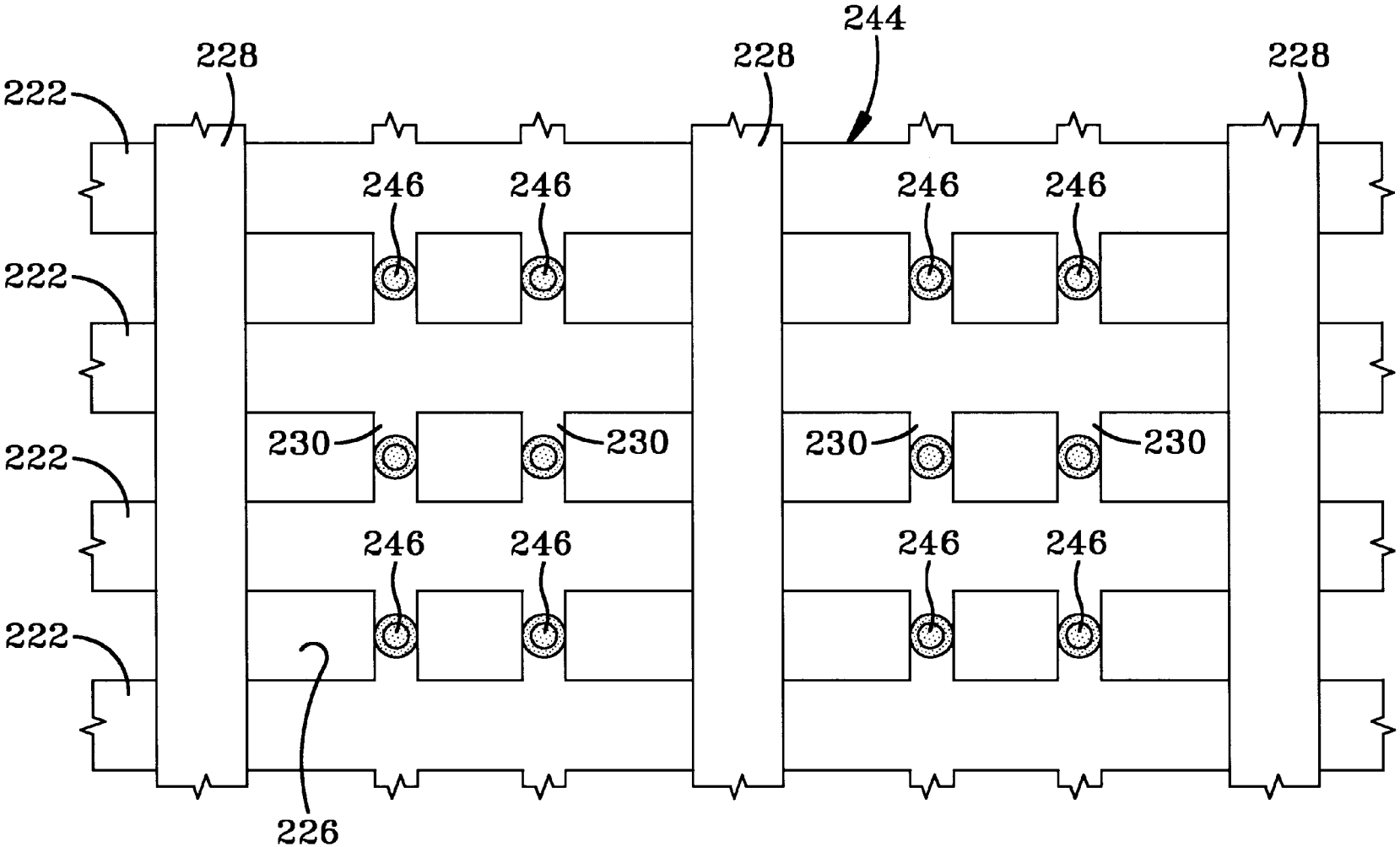
FIG. 10 is a view similar to FIG. 9 taken along line 10—10 of FIG. 8.

A fourth embodiment of the floor mat system of the present invention is indicated generally by the numeral 242 is FIG. 8. Floor mat system 242 includes many of the same elements as floor mat system 200 described above. However, floor mat system 242 includes a plurality of floor mats 244 that differ from floor mats 214 in that they include a plurality of support knobs 246 that are smaller than support knobs 240. Each support knob 246 is conical but disposed on middle rib 230 between first ribs 222 as shown in FIG. 10. The configuration of FIG. 8 provides even more points of support to floor mat 244 without clogging drainage channels 238.

Figure 11:
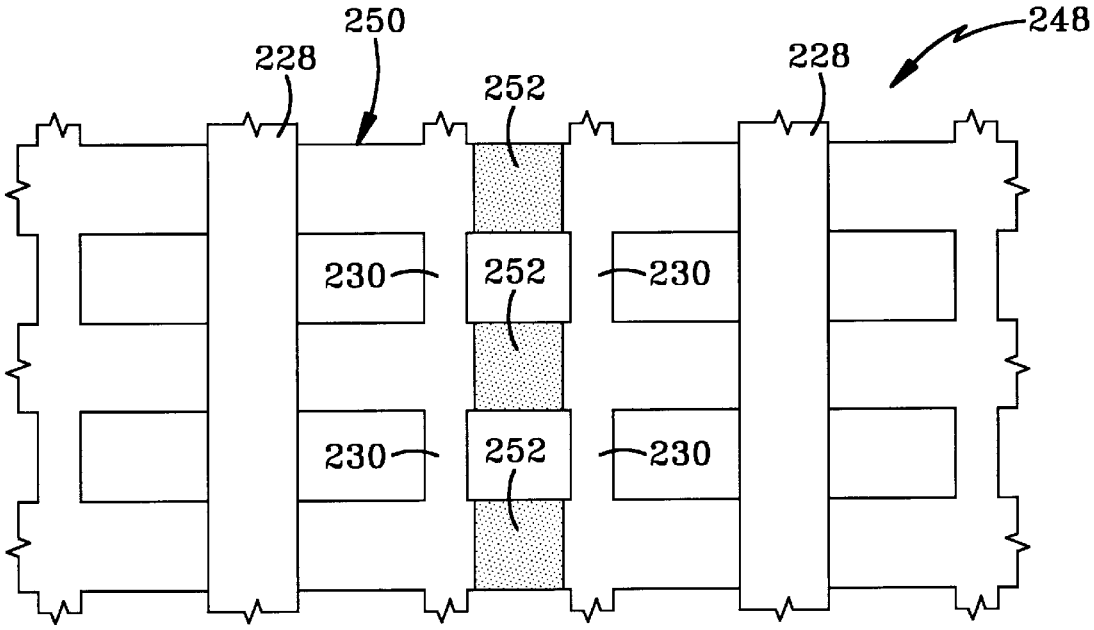
FIG. 11 is a view similar to FIG. 9 showing a fifth embodiment of the floor mat.

A fifth embodiment of the floor mat system of the present invention is indicated generally by the numeral 248 in FIG. 11. System 248 includes floor mats 250 having substantially the same elements as floor mats 214 described above except that the support knobs 252 of floor mat 250 are of a substantially rectangular parallelepiped configuration. In the preferred embodiment of the invention, support knobs 252 have a square cross-section. Support knobs 252 are disposed in substantially the same location with respect to ribs 222 and 224 as support knobs 240.

Figure 12:
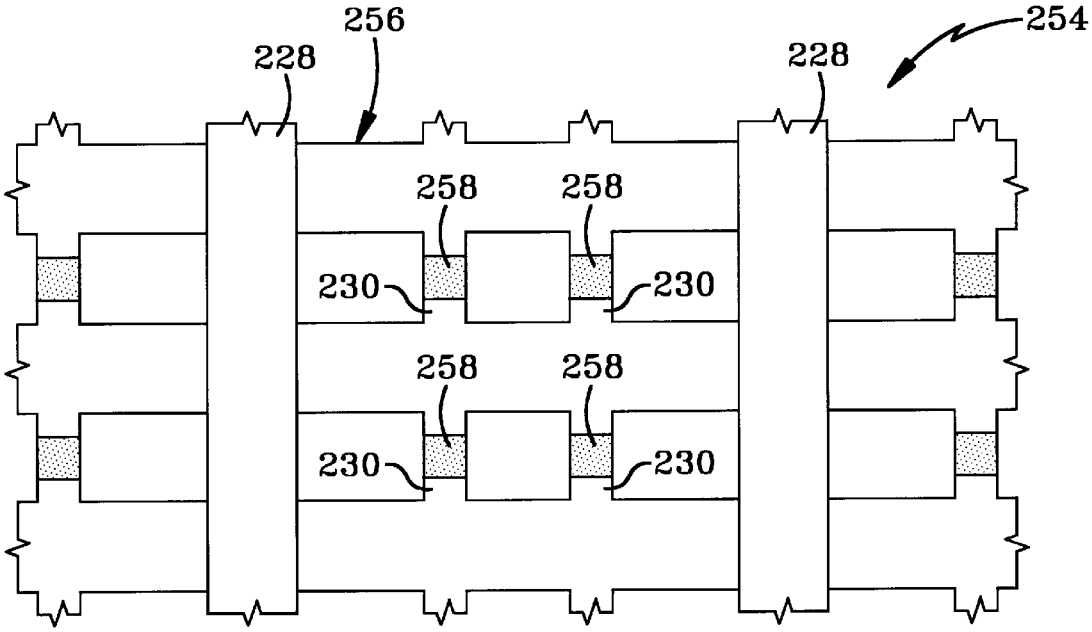
FIG. 12 is a view similar to FIG. 9 showing a sixth embodiment of the floor mat.

A sixth embodiment of the floor mat system is indicated generally by the numeral 254 in FIG. 12. System 254 includes a plurality of floor mats 256 that have many of the same elements as floor mats 214. The support knobs 258 of floor mat 256 have the same cross-sectional shape as support knobs 252 but are substantially smaller than support knobs 252. Support knobs 258 are disposed in substantially the same location with respect to ribs 222 and 224 as support knobs 246.

Figure 13:
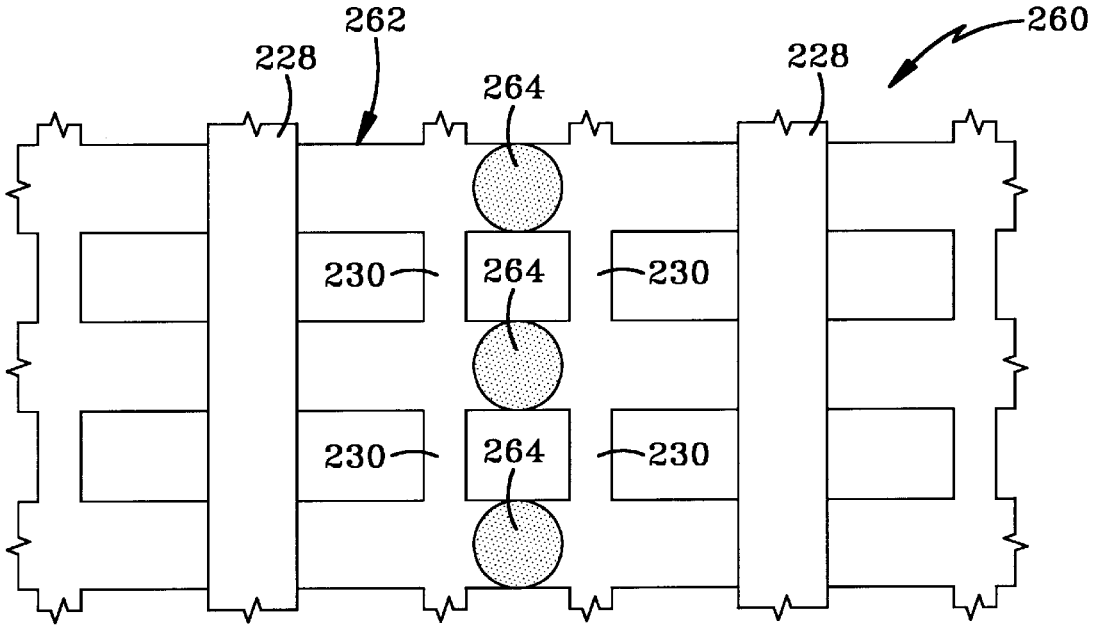
FIG. 13 is a view similar to FIG. 9 showing a seventh embodiment of the floor mat.

A seventh embodiment of the floor mat system of the present invention is indicated generally by the numeral 260 in FIG. 13. System 260 includes a plurality of floor mats 262 having many of the same elements as floor mats 214 described above. The support knobs 264 of system 260 are substantially cylindrical in shape and are disposed in the same location with respect to ribs 222 and 224 as support knobs 240.

Figure 14:
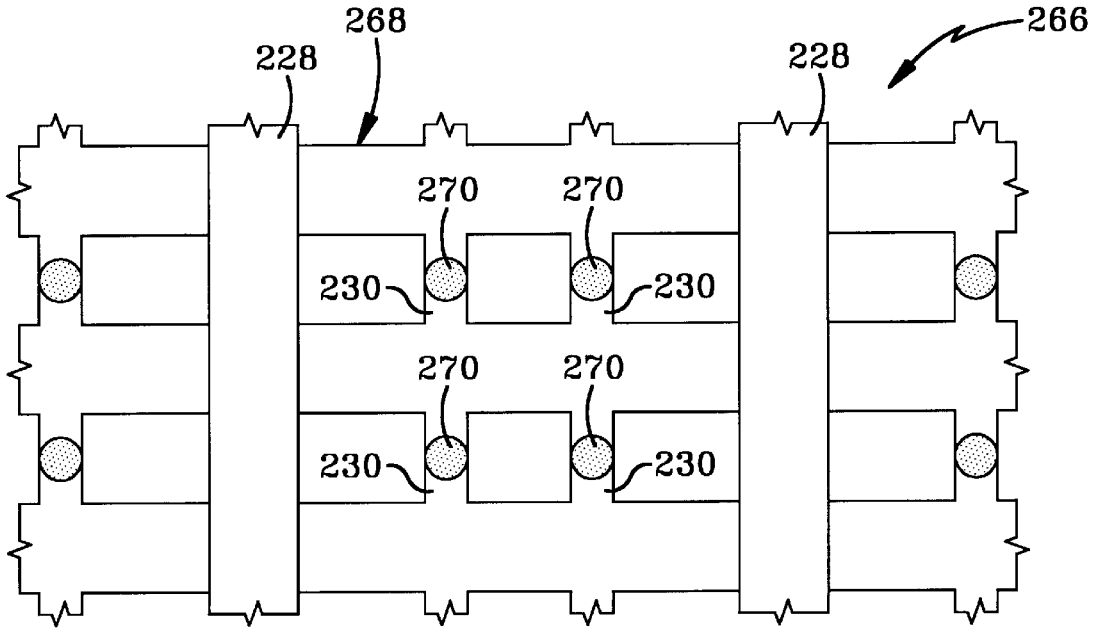
FIG. 14 is a view similar to FIG. 9 showing an eighth embodiment of the floor mat.

FIG. 14 depicts an eighth embodiment of the system of the present invention. The eighth embodiment of the system is indicated generally by the numeral 266. System 266 includes a plurality of floor mats 268 that are substantially the same as floor mats 214 described above. Floor mats 268 include support knobs 270 that are cylindrical and are disposed in substantially the same location with respect to ribs 222 and 224 as support knobs 246.

Having now described the various structures of the floor mats capable of being used with the floor mat system of the present invention, the manner in which the floor mat system is used to support a heavy load without allowing individual floor mats 214 to move up and out of frame system 216 will now be described. It has been found in the art that when transport vehicle 202 is rolled across prior floor mat grids, the individual floor mats are urged out from the frames where they can be tripped over or stop the wheels of the transport vehicle. System 200 of the present invention allows transport vehicle 202 to be rolled over floor mats 214 without allowing floor mats 214 to come up and out of frame system 216. This is accomplished without the use of clips or hold down devices that permanently lock the position of floor mats 214 with respect to floor 236, as will be set forth more fully below. Each floor mat 214 may be readily lifted up away from frame system 216 to allow debris to be cleaned from under system 200.

In accordance with one of the objectives of the present invention, each floor mat 214 has a length, indicated by a dimension line labeled by the numeral 280, and a width, indicated by the dimension line labeled by the numeral 282

Figure 15:
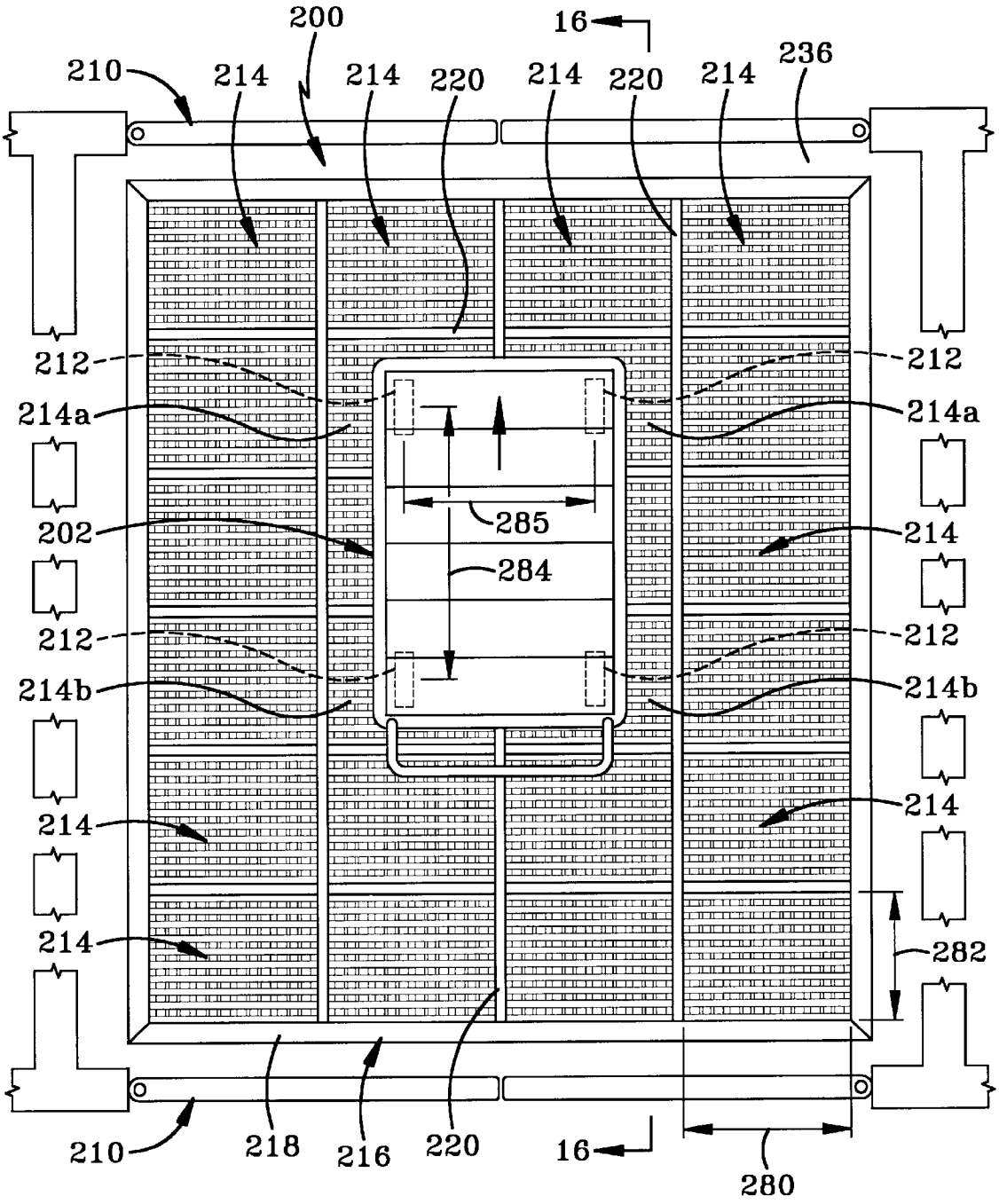
FIG. 15 is a view similar to FIG. 6 showing the rolling load disposed in the middle of the floor mat system.
Figure 16:
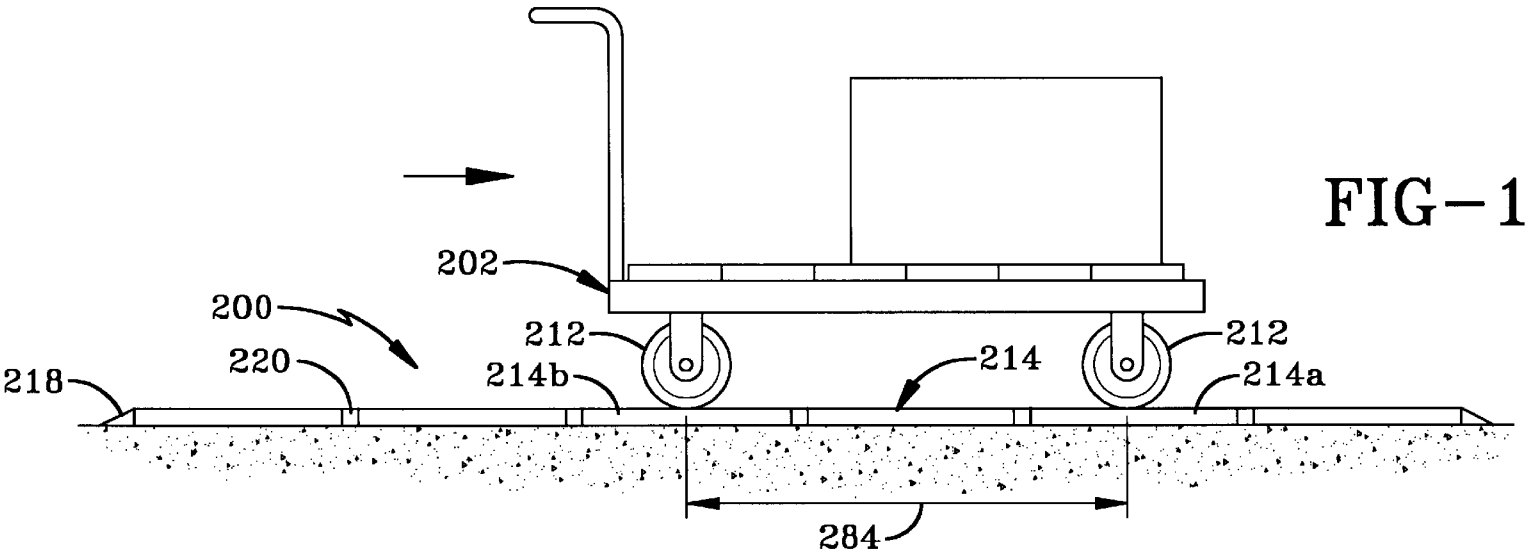
FIG. 16 is a sectional view taken along line 16—16 of FIG. 15.

(See FIG. 15). Floor mats 214 are arranged so that widths 282 are directed in the direction of travel for transport vehicle 202. As is understood in the relevant art, transport vehicle 202 includes four wheels at opposite corners thereof that are arranged into two pairs of spaced apart coaxial wheels, with each pair of wheels rotating about an imaginary axis, the two imaginary axes being parallel and spaced apart. The distance between the two imaginary axes constitutes a wheelbase distance indicated by the numeral 284. The distance by which each pair of coaxial wheels is separated defines a track distance indicated by the numeral 285. In accordance with one of the objectives of the present invention, length 280 and width 282 are sized such that any two wheels 212 of vehicle 202 cannot rest on a single floor mat 214 at any given time. In the preferred embodiment of the present invention, an entire width 282 (and thus an entire floor mat 214) is disposed between the floor mats 214*a* and 214*b* that together support a pair of wheels 212. It can be seen, therefore, that width 282 is less than wheelbase distance 284. Similarly, length 280 of each floor mat 214 is less than track distance 285 such that any pair of coaxial wheels, i.e., the front wheels or the rear wheels, will never lie on a single floor mat 214, but rather will rest on two adjacent floor mats 214. It has been found as part of the present invention that the configuration of length 280 and width 282 in this manner prevents wheels 212 from working together to dislodge floor mat 214 from frame system 216.

Providing floor mats 214 in the manner discussed above insures that only one wheel of transport vehicle 202 will reside on a single floor mat 214 at a given time. This prevents two wheels 212 of transport vehicle 202 from working together to move floor mat 214. In the past, two wheels 212 present on floor mat 214 would cooperate to move mat 214 out of its desired location. This problem forced workers to reposition floor mats because misplaced floor mats could trip those walking over the floor mat or jam wheels 212 of transport vehicle 202 as it was rolled over the floor mat. The arrangement of the present invention prevents these problems because wheels 212 cannot cooperate together to dislodge floor mat 214.

System 200 may be arranged by first selecting a location on a floor on which to install system 200. The person installing system 200 then selects floor mats 214 having the desired widths 282 in lengths 280 so that two wheels 212 of transport vehicle 202 cannot reside on a single floor mat 214 at any given time in the length-wise, width-wise, or diagonal directions. The person arranging system 200 then lays out the total number of floor mats 214 to fill the selected area. The elements and dimensions of frame 216 are then determined and installed.

In the preferred embodiment of the present invention, each floor mat 214 is preferably eighteen by twenty-four inches. However, in other embodiments of the invention, each floor mat 214 may be as small as eight by twelve inches to as large as twenty-four by thirty-six inches. Although it is desired that width 282 be directed in the intended direction of wheeled traffic, lengths 280 may also be sized to be less than wheelbase distance 284 such that traffic crossing in the length direction will also not dislodge floor mats 214. It is also desired to size floor mats 214 such that the diagonal length of each floor mat 214 is less than one of track distance 285 and wheelbase distance 284 so that diagonal traffic across system 200 will not dislodge floor mats 214.

Figure 18:
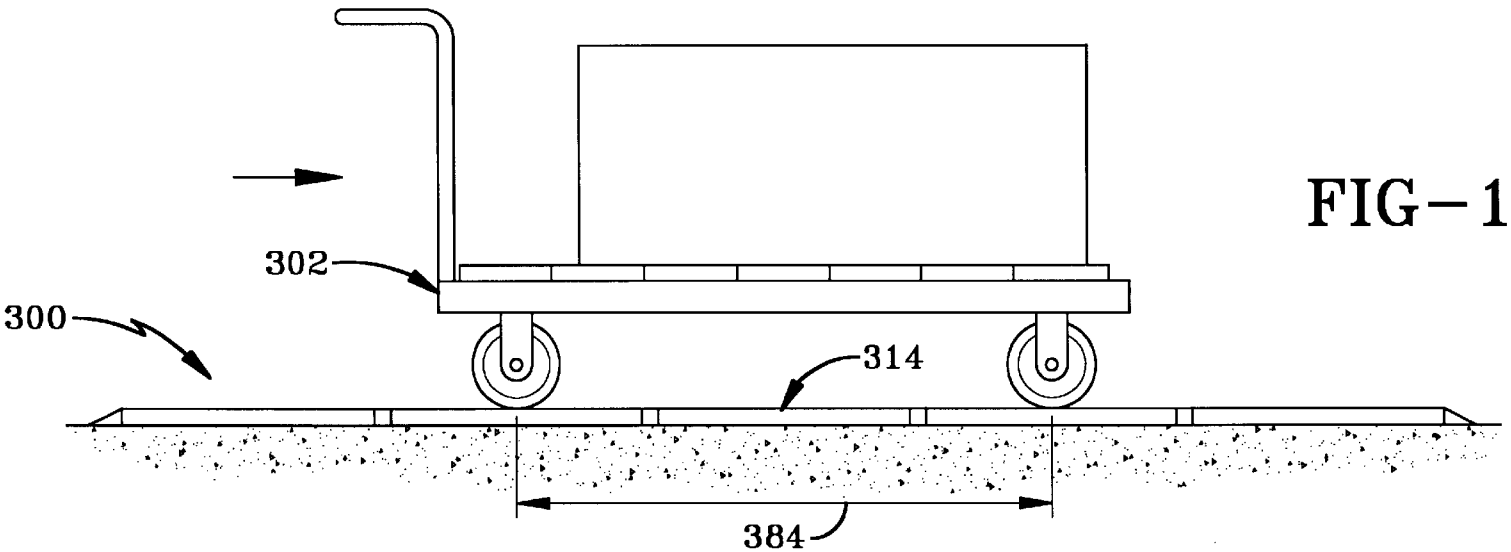
FIG. 18 is a sectional view taken along line 18—18 of FIG. 17.
Figure 17:
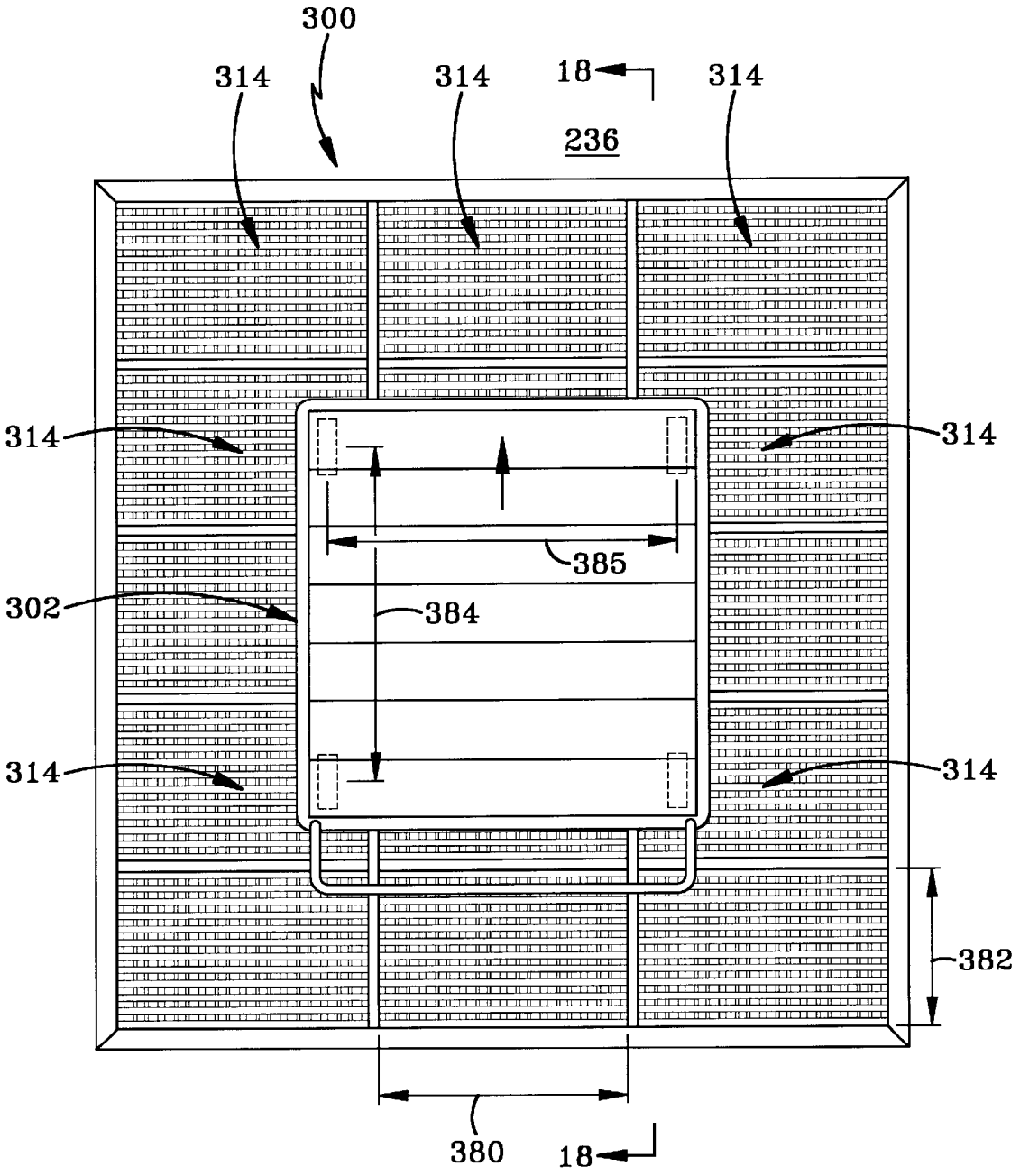
FIG. 17 is a view similar to FIG. 6 showing an alternative configuration of the floor mat system of the present invention.

An alternative embodiment of system 200 is depicted in FIGS. 17 and 18 and is indicated generally by the numeral 300. System 300 includes many of the same elements as system 200 and similar numbers are referred to similar elements. System 300 is intended to be used with a transport vehicle 302 having a larger wheel base 384 than vehicle 202. The larger wheel base 384 allows floor mats 314 to have a width 382 that is larger than width 282 as described above. The wheel configuration of vehicle 302 may also allow length 380 to be larger than length 280.

Figure 19:
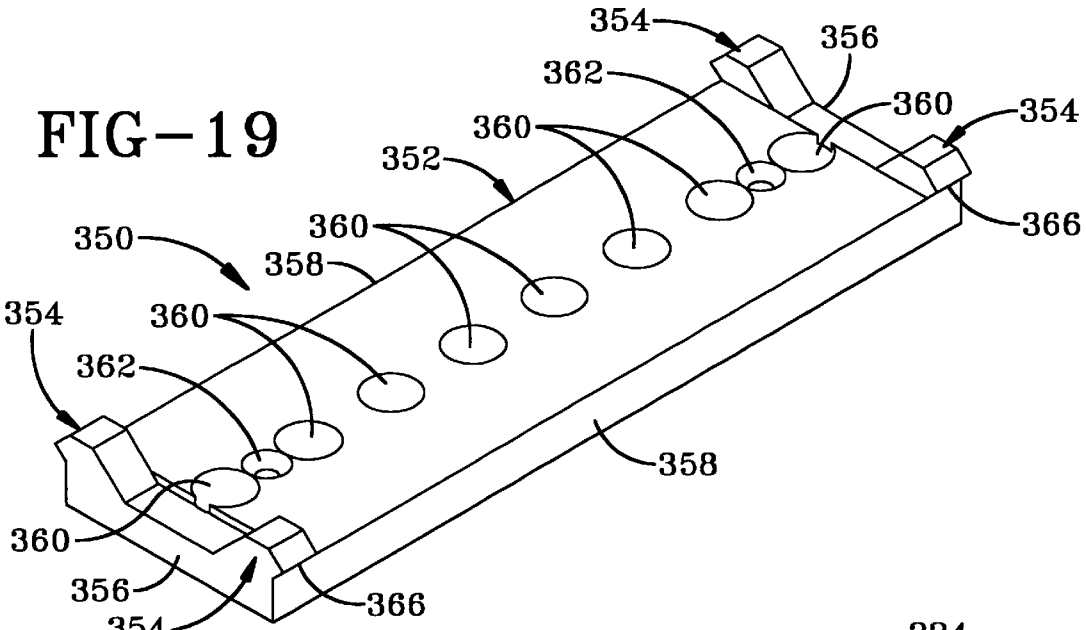
FIG. 19 is a perspective view of a clip used with the floor mat system of the present invention.
Figure 21:
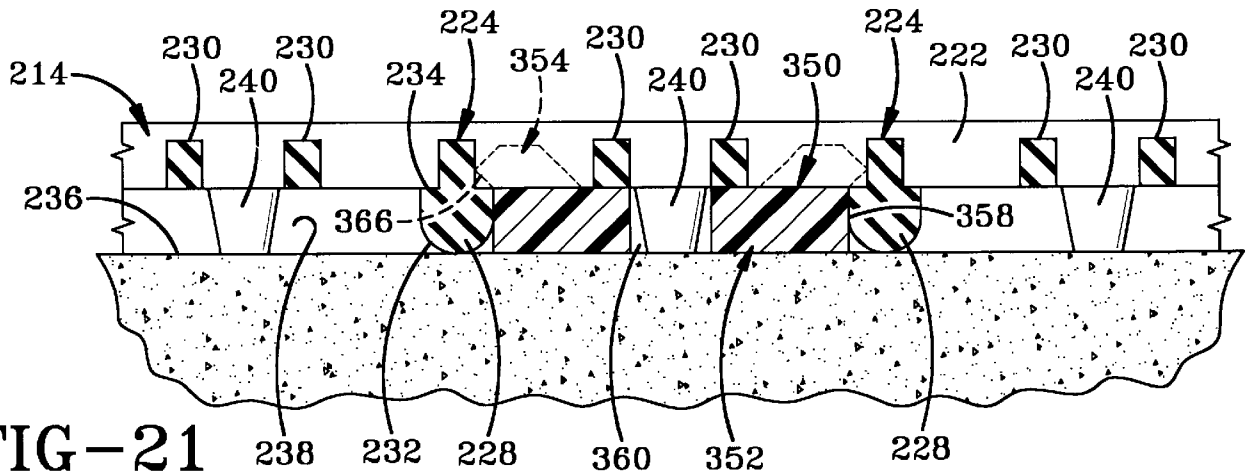
FIG. 21 is a sectional view taken along line 21—21 of FIG. 20.

In accordance with another objective of the present invention, a clip 350 is depicted in FIGS. 19–21. Clip 350 is intended to be used with floor mats 214 described above. The operation of clip 350 is similar to that of the clip disclosed in U.S. Pat. No. 5,882,764, the disclosures of which are incorporated herein by reference.

Clip 350 includes a substantially rectangular body 352 and two pairs of ears 354 extending therefrom. Body 352 is a substantially rectangular parallelepiped-shaped member terminating at a pair of opposed ends 356 and at a pair of opposed sides 358. Body 352 is formed with a plurality of relief holes 360 that are sized and spaced apart to accommodate support knobs 240 therein. Body 352 is also formed with two fastening holes 362 that are each sized to accommodate a screw 364 therethrough for purposes of fastening clip 350 onto floor 236.

As is best shown in FIG. 19, ears 354 are each disposed adjacent ends 356 and protrude both upwardly from body 352 and outwardly beyond sides 358. The portion of each ear 354 that protrudes outward from body 352 beyond side 358 constitutes a latching ledge 366. Latching ledges 366 lockingly engage facing shoulders 234 of support ribs 228 to removably retain floor mat 214 against floor 236. Latching ledges 366 each are formed with a beveled lower surface that retains floor mat 214 against floor 236 during use, but permits floor mat 214 to be pulled upward and out of engagement with latching ledges 236 when it is desired to remove floor mat 214 from floor 236 for purposes of cleaning and for other such purposes. While clip 350 is shown with relief holes 360 that correspond with support knobs 240 of floor mat 214, it is understood that clip 350 and relief holes 360 can be reconfigured to cooperate with mat 244, mat 250, mat 256, mat 262, and mat 268.

Accordingly, the improved floor mat system is simplified, provides an effective, safe, inexpensive, and efficient device which achieves all the enumerated objectives, provides for eliminating difficulties encountered with prior art devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved floor mat system is constructed and used, the characteristics of the construction, and the advantageous, new and useful results obtained; the new and useful structures, devices, elements, arrangements, parts and combinations, are set forth in the appended claims.

What is claimed is:

1. A floor mat system adapted to lie against a floor, the floor mat system comprising:

a plurality of support ribs, each support rib having a lower surface, the lower surfaces being adapted to rest on the floor;

a plurality of first ribs disposed transverse to the support ribs;

the first ribs having a lower surface disposed vertically higher than the lower surface of the support ribs;

a plurality of support knobs extending downwardly from the lower surfaces of the first ribs; each of the support knobs having a lower surface; the lower surfaces of the support knobs being substantially coplanar with the lower surface of the support ribs; and a clip adapted to hold the floor mat to the floor; the clip engaging at least one support rib; the clip defining at least one hole; one of the support knobs being at least partially positioned in the hole.

2. The floor mat system of claim 1, wherein the clip defines a plurality of holes; a support knob being disposed in each of the holes.

3. A floor mat system adapted to lie against a floor, the floor mat system comprising:

a floor mat having a plurality of support knobs; each of the support knobs having a lower surface; the lower surfaces of the support knobs being adapted to engage the floor; and a clip adapted to hold the floor mat to the floor; the clip engaging the floor mat; the clip defining at least one hole; one of the support knobs of the floor mat being at least partially positioned in the hole.

4. The floor mat system of claim 3, wherein the clip defines a plurality of holes; a support knob being at least partially disposed in each of the holes.

5. The floor mat system of claim 4, wherein a support knob is disposed in each of the holes.

6. The floor mat system of claim 3, wherein the floor mat includes a plurality of first ribs and a plurality of second ribs; the second ribs being disposed substantially perpendicular to the first ribs.

7. The floor mat system of claim 6, wherein the clip is adapted to engage the first ribs.

8. The floor mat system of claim 6, wherein the first ribs are adapted to engage the floor; the second ribs being adapted to be disposed above the floor.

9. The floor mat system of claim 3, wherein the support knobs are aligned with each other.

10. The floor mat system of claim 3, wherein each of the support knobs is substantially cylindrical.

11. The floor mat system of claim 3, wherein each of the support knobs is substantially conical.

12. The floor mat system of claim 3, wherein each of the support knobs has a substantially rectangular cross-section.

13. The floor mat system of claim 3, wherein one of the support knobs of the floor mat is disposed in the hole of the clip.

14. The floor mat system of claim 3, wherein the floor mat includes a plurality of ribs; the clip adapted to engage the ribs.

15. A floor mat system adapted to lie against a floor, the floor mat system comprising:

a floor mat having a plurality of first ribs and a plurality of support knobs; the first ribs having a lower surface; each of the support knobs having a lower surface; the lower surfaces of the first ribs and the lower surfaces of the support knobs being adapted to engage the floor; and a clip adapted to removably and replaceably hold the floor mat to the floor; the clip engaging the floor mat; the clip defining at least one hole; one of the support knobs of the floor mat being at least partially disposed in the hole.

16. The floor mat system of claim 15, wherein the clip engages the first ribs.

17. The floor mat system of claim 15, wherein the floor mat includes a plurality of second ribs disposed substantially perpendicular to the first ribs.

18. The floor mat system of claim 17, wherein each of the second ribs has a lower surface; the lower surface of each second rib being disposed above the lower surface of each first rib.

19. The floor mat system of claim 15, wherein the clip engages spaced apart first ribs.

20. The floor mat system of claim 19, wherein the floor mat system includes second ribs disposed substantially perpendicular to the first ribs; the clip engaging a first rib at two spaced apart locations; at least one second rib being disposed between the locations where the clip engages the first rib.

21. The floor mat system of claim 15, wherein the clip includes ears that engage the floor mat.

22. The floor mat system of claim 21, wherein each ear has a triangular cross section.

* * * * *